US009892881B2

(12) United States Patent
Thomas

(10) Patent No.: US 9,892,881 B2
(45) Date of Patent: Feb. 13, 2018

(54) CIRCUIT BREAKER ALARM MODULE ACCESSIBLE FOR MANUAL TESTING

(71) Applicant: Siemens Aktiengesellschaft, München (DE)

(72) Inventor: Stephen Scott Thomas, Atlanta, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 204 days.

(21) Appl. No.: 14/855,469

(22) Filed: Sep. 16, 2015

(65) Prior Publication Data

US 2017/0076577 A1 Mar. 16, 2017

(51) Int. Cl.
*H01H 9/00* (2006.01)
*H01H 71/04* (2006.01)
*H01H 9/16* (2006.01)

(52) U.S. Cl.
CPC ..... *H01H 71/04* (2013.01); *H01H 9/16* (2013.01)

(58) Field of Classification Search
CPC .... H01H 71/46; H01H 71/462; H01H 71/465; H01H 71/04
USPC ..... 200/308; 335/17
See application file for complete search history.

(56) References Cited

U.S. PATENT DOCUMENTS

| | | | | |
|---|---|---|---|---|
| 4,211,989 | A * | 7/1980 | Acampora | H01H 71/46 200/308 |
| 5,502,286 | A * | 3/1996 | Pollman | H01H 71/465 200/308 |
| 5,673,786 | A * | 10/1997 | Seymour | H01H 71/465 200/308 |
| 5,936,535 | A | 8/1999 | Rosen et al. | |
| 6,403,902 | B1 | 6/2002 | Castonguay et al. | |
| 7,843,291 | B2 | 11/2010 | Titus | |
| 2005/0248897 | A1 | 11/2005 | Sadjadi | |
| 2014/0251775 | A1 | 9/2014 | Cardwell et al. | |
| 2015/0035629 | A1 | 2/2015 | Thomas | |
| 2015/0053541 | A1 | 2/2015 | Rojko | |

* cited by examiner

*Primary Examiner* — Vanessa Girardi

(57) ABSTRACT

A short circuit indicating alarm module (SCIAM). The SCIAM includes a housing, a latch pivotally mounted relative the housing, the latch including a latching member configured to be contacted by a catch of a trip bar, and a plunger translatable relative to the housing and configured, upon depressing, to contact and trip the trip bar. Modular assemblies of a circuit breaker, trip indicating assemblies, and methods of testing short circuit indicating alarm modules are provided, as are other aspects.

18 Claims, 11 Drawing Sheets

CIRCUIT BREAKER ALARM MODULE ACCESSIBLE FOR MANUAL TESTING

FIELD

The present invention relates generally to accessories for circuit breakers, such as short circuit indicating alarm modules.

BACKGROUND

In general, a circuit breaker operates to engage and disengage a selected branch electrical circuit from an electrical power supply. The circuit breaker provides current interruption thereby providing protection to the electrical circuit from continuous over-current conditions and/or high-current transients due, for example. Such circuit breakers operate by separating internal electrical contacts contained within a housing of the circuit breaker.

In some embodiments, the circuit breakers include a thermal-magnetic trip unit wherein the contact arms blow apart from the stationary contacts due to magnetic forces or as a result of thermal heating of a bimetal element. In such thermal-magnetic circuit breakers, an accessory pocket may be provided that includes a magnetic trip bar that rotates in response to a short circuit that trips the circuit breaker and disconnects the electrical contacts. Certain thermal-magnetic circuit breakers may include a short circuit indicating accessory module in the accessory pocket. Furthermore, certain thermal-magnetic circuit breakers may include an internal trip switch that is activated by rotation of the trip bar to send an electrical signal to a location indicating the circuit breaker has been tripped. The short circuit indicating accessory module may mechanically and visually indicate that a short circuit trip has occurred by either sounding an alarm or providing a visual indicator.

However, such thermal-magnetic circuit breakers including short circuit indicating accessory modules may be deficient in some respects. Thus, improved short circuit indicating accessory module and assemblies including them are desired.

SUMMARY

According to a first aspect, a short circuit indicating alarm module is provided. The short circuit indicating alarm module includes a housing, a latch pivotally mounted relative the housing, the latch including a latching member configured to be contacted by a catch of a trip bar, and a plunger translatable relative to the housing and configured, upon depressing, to contact and trip the trip bar.

In accordance with another aspect, a trip indicator assembly is provided. The trip indicator assembly includes a trip bar including a catch and a trip contact surface, and a short circuit indicating alarm module, including a housing, a latch pivotally mounted relative the housing, the latch including a latching member configured to be contacted by the catch of the trip bar, and a plunger translatable relative to the housing and configured, upon depressing, to contact the trip contact surface of the trip bar.

In accordance with another aspect, a modular assembly of a circuit breaker including a short circuit indicating accessory module is provided. The modular assembly includes a base housing including an accessory pocket, a trip bar mounted for rotation in the base housing about a pivot axis, the trip bar including a first contact area configured to be contacted by a mechanism of the circuit breaker, a catch offset from the pivot axis, and a trip contact surface, and a short circuit indicating alarm module received in the accessory pocket, comprising a housing, a latch pivotally mounted relative the housing, the latch including a latching member configured to be contacted by the catch of the trip bar, and a plunger moveable relative to the housing and configured, upon depressing, to contact the trip contact surface to trip the trip bar as a test.

In accordance with another aspect, a method of testing a short circuit indicating alarm module of a circuit breaker is provided. The method includes providing a trip bar including a catch and a trip contact surface, providing the short circuit indicating alarm module including a housing, a latch pivotally mounted relative the housing, the latch including a latching member configured to be contacted by the catch of the trip bar, and a plunger moveable relative to the housing, and depressing the plunger and contacting the trip contact surface of the trip bar to trip the trip bar as a test.

Still other aspects, features, and advantages of the present invention may be readily apparent from the following description by illustrating a number of example embodiments, including the best mode contemplated for carrying out the present invention. The present invention may also be capable of different embodiments, and its details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the appended claims.

BRIEF DESCRIPTION OF DRAWINGS

The drawings, described below, are for illustrative purposes only and are not necessarily drawn to scale. Like reference numerals used in the drawings identify similar or identical elements throughout the several views. The drawings are not intended to limit the scope of the invention in any way.

DESCRIPTION

Figure 1A:
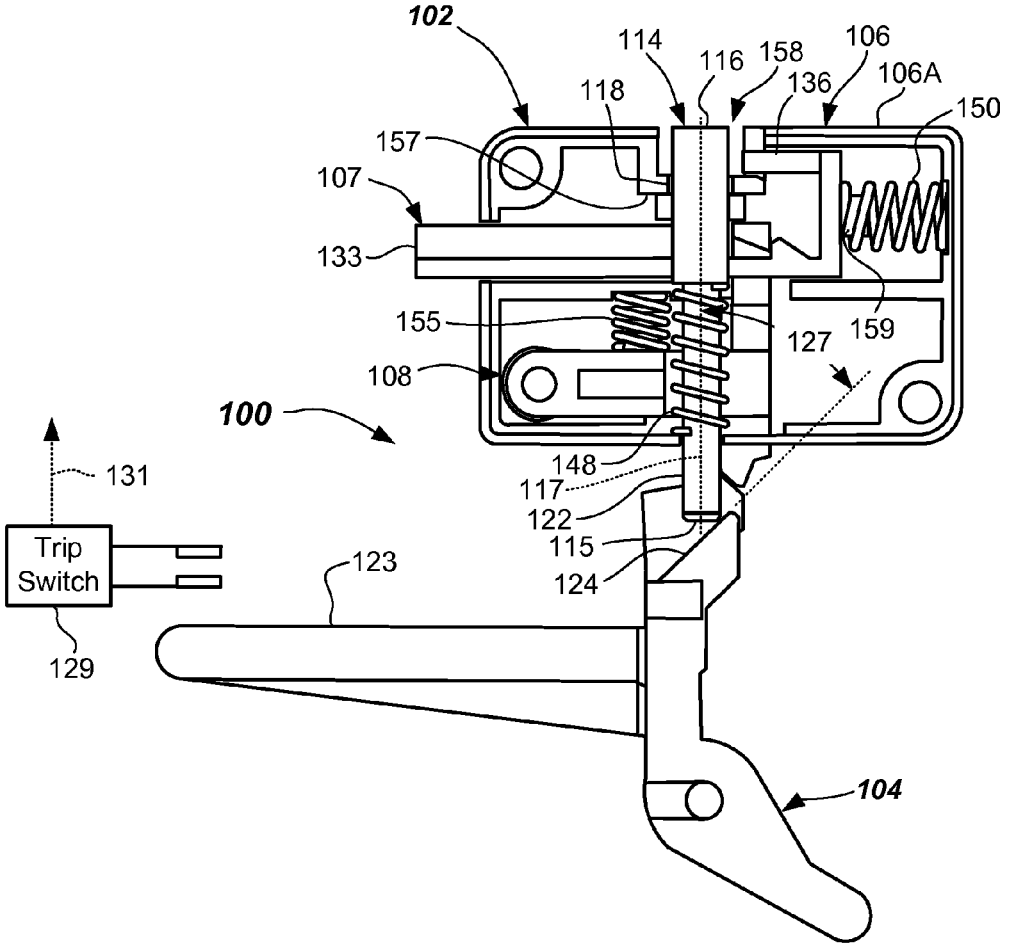
FIG. 1A illustrates a side plan view of a trip indicator assembly including a short circuit indicating alarm module with the right side case removed for illustration purposes, wherein the short circuit indicating alarm module is shown in a non-tripped condition according to one or more embodiments.

Reference will now be made in detail to the example embodiments of this disclosure, which are illustrated in the accompanying drawings.

In order to ensure that an accessory module is fully functional, embodiments of the invention provide test functionality to the accessory module, so that the operability of the accessory module and possibly other components may be tested without having to apply high current levels to the circuit breaker. This avoids degradation of the electrical contacts of the circuit breaker with which the accessory module operates. In one or more embodiments, a short circuit indicating accessory module is provided. The short circuit indicating accessory module, in operation, indicates that a magnetic trip event has occurred, and a test plunger is provided, which when depressed by an operator, engages with and moves (e.g., rotates) a trip bar. This allows the operator to trip the circuit breaker to test the short circuit indicating accessory module and also any other switching component without applying a current to the circuit breaker. Once tripped, the short circuit indicating accessory module provides reset capability wherein an operator can reset the short circuit indicating accessory module upon depressing a slider member. Once the slider member is reset, thereby releasing the trip bar and allowing the trip bar to return to a normal position, then the circuit breaker handle can be returned to the ON position.

One or more embodiments of the invention are directed at a short circuit indicating alarm module including a housing, a latch pivotally mounted in the housing, the latch including a latching member that is configured to be contacted by a catch of a trip bar, and a plunger that is translatable relative to the housing and configured, upon depressing, to contact and trip the trip bar as a test.

In other embodiments, a trip indicating assembly for use with a circuit breaker is provided. The trip indicating assembly includes the short circuit indicating alarm module and a trip bar.

One or more embodiments of the invention may be used with one-pole or two-pole thermal-magnetic circuit breakers. Such thermal-magnetic circuit breakers may include ratings of between about 100 Amp to 2000 Amp (including ratings of 100 Amp, 250 A Amp, 600 Amp, 1000 Amp, 1200 Amp, and 2000 Amp), for example.

These and other embodiments of short circuit indicating alarm module, trip indicator assemblies for circuit breakers, modular assemblies for circuit breakers including short circuit indicating alarm module, as well as methods of testing a short circuit indicating alarm module are described below with reference to FIGS. 1A-8 herein.

Referring now to FIGS. 1A-1D, a trip indicating assembly 100 including a short circuit indicating alarm module 102 is provided in accordance with one or more embodiments of the invention. Trip indicating assembly 100 includes the short circuit indicating alarm module 102 and a trip bar 104.

In more detail, the short circuit indicating alarm module 102 includes a housing 106, and a latch 108 pivotally mounted relative the housing 106. Further, the latch 108 includes a latching member 110 configured to be contacted by a catch 112 of the trip bar 104 as the trip bar 104 rotates.

Additionally, the short circuit indicating alarm module 102 includes a plunger 114 that is translatable and reciprocatable relative to the housing 106 and configured, upon an operator depressing the upper end 116 thereof, to contact and manually trip the trip bar 104 and thereby trip the circuit breaker. Short circuit indicating alarm module 102 may further include a slider member 107 to be described fully below.

Figure 1B:
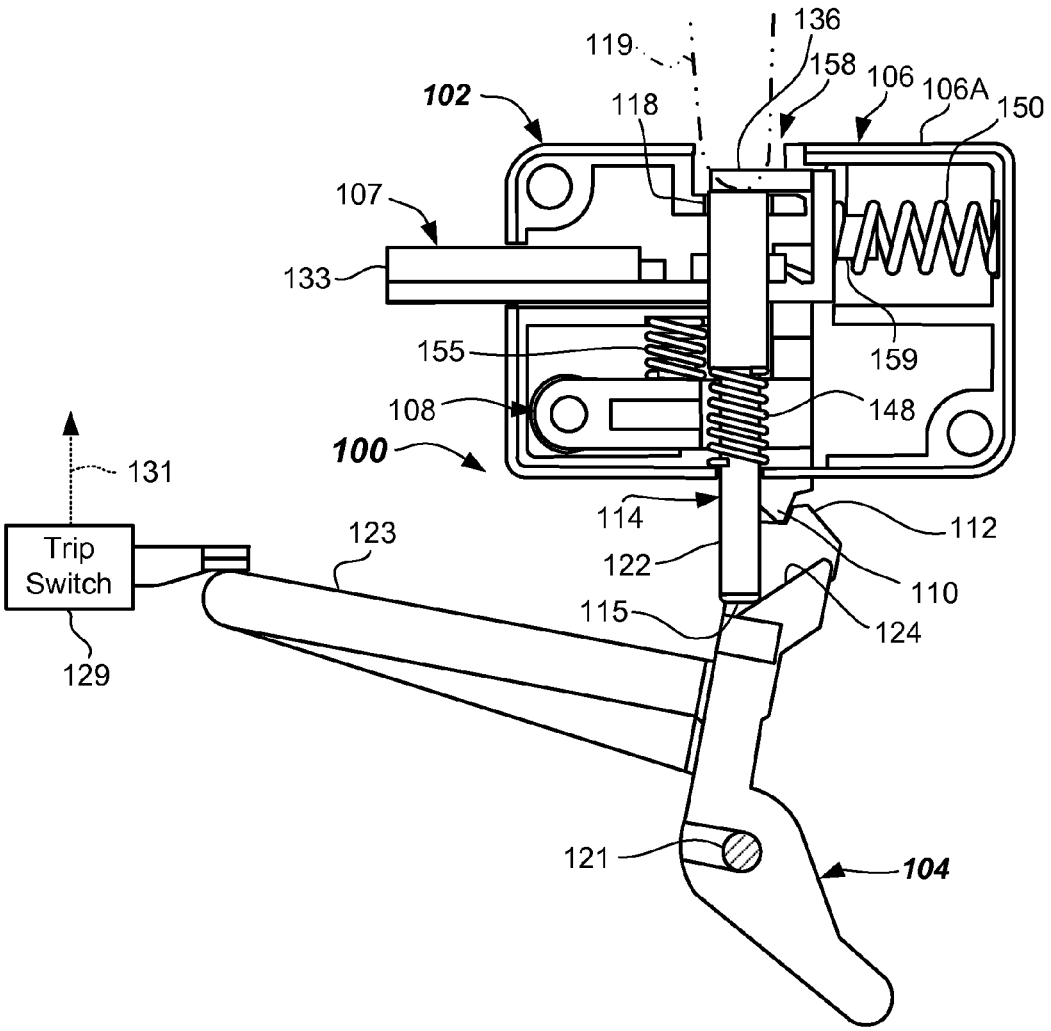
FIG. 1B illustrates a side plan view of a trip indicator assembly including a short circuit indicating alarm module with the right side case removed for illustration purposes, wherein the short circuit indicating alarm module is shown in a tripped condition, according to one or more embodiments.

Trip indicating assembly 100 includes the trip bar 104 with the catch 112 as previously discussed, and further includes a trip contact surface 124, which is configured to be engageable by an engaging end 115 of the plunger 114. Trip contact surface 124 may be arranged along a side of the catch 112, and may be an inclined surface. The trip contact surface 124 may be inclined. For example, trip contact surface 124 may be inclined at an incline angle 127 of between about 25 degrees and about 50 degrees, as measured between an inclined plane of the trip contact surface 124 and an axial axis 117 of the plunger 114. The plunger 114 is translatable relative to the housing 106 along the axial axis and is configured, upon being depressing by an operator (e.g., by depressing with a user's finger 119), to contact the trip contact surface 124 of the trip bar 104. This causes the trip bar 104 to rotate about trip bar axle 121, as shown in FIG. 1B. As a result, the circuit breaker may be tripped, but also, a switch arm 123 may be rotated, which may activate a trip switch 129 that may send a signal in signal line 131 that the circuit breaker has been magnetically tripped. Trip switch 129 may be an internal switch of the circuit breaker.

As can be seen in FIG. 1B, once the circuit breaker has been tripped, the latching member 110 on the latch 108 engages the catch 112 of the trip bar 104 and holds the trip bar 104 in the tripped position, as shown. The trip bar 104 may be returned to the ON position after the operator moves the slider member 107 to rotate and release the latch 108. This raises the latching member 110 and allows the trip bar 104 to return to a non-tripped condition as shown in FIG. 1A, then the circuit breaker can be reset and the breaker handle can be returned to the ON position. The slider member 107 may be moved by contacting the end of the trip indicating flag 136 with a tool, such as a flat-head screwdriver, for example.

Figure 1C:
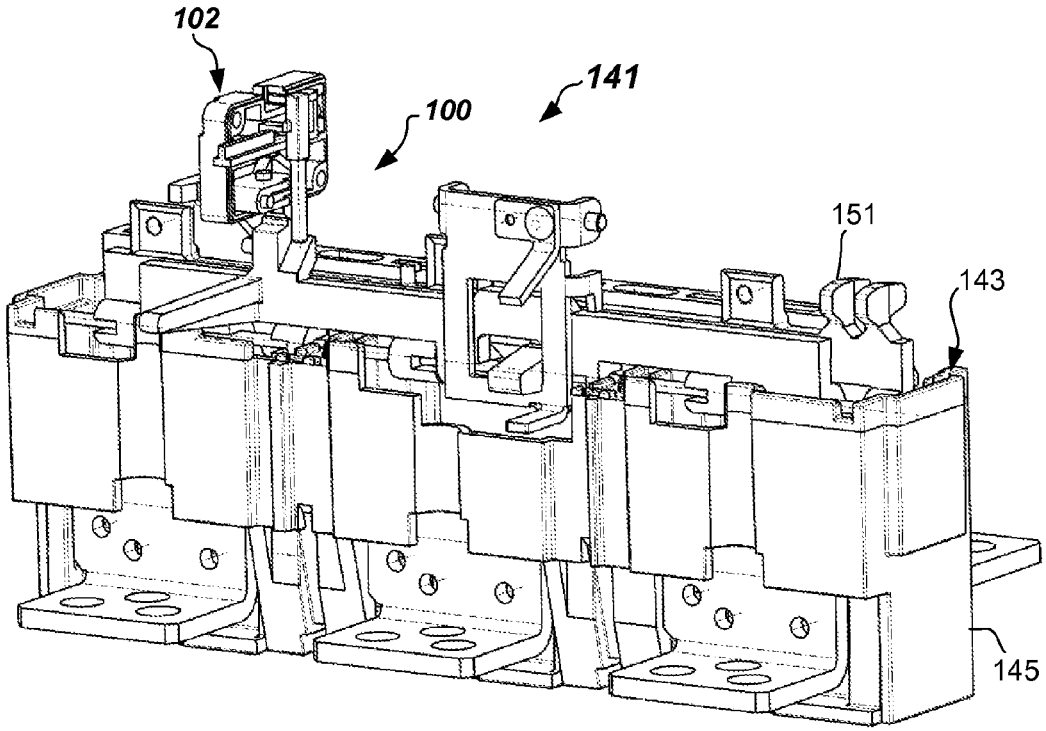
FIG. 1C illustrates an isometric view of a modular assembly including a short circuit indicating alarm module with the right side case removed for illustration purposes, and shown in a non-tripped condition, according to one or more embodiments.
Figure 1D:
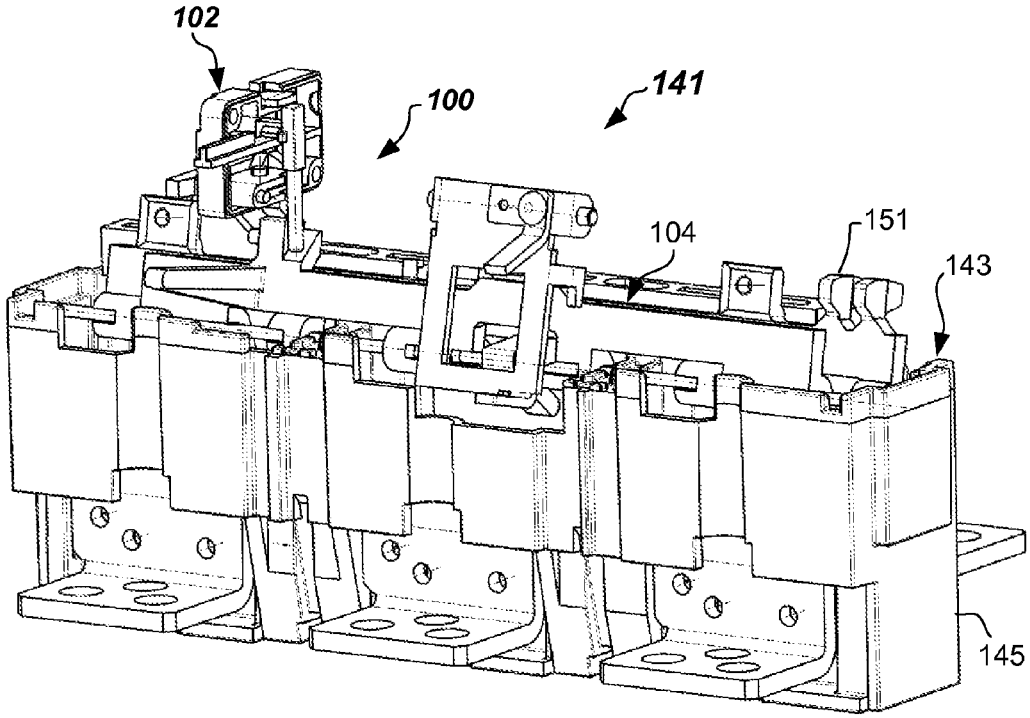
FIG. 1D illustrates an isometric view of a modular assembly including a short circuit indicating alarm module with the right side casing removed for illustration purposes, and shown in a tripped condition, according to one or more embodiments.
Figure 1E:
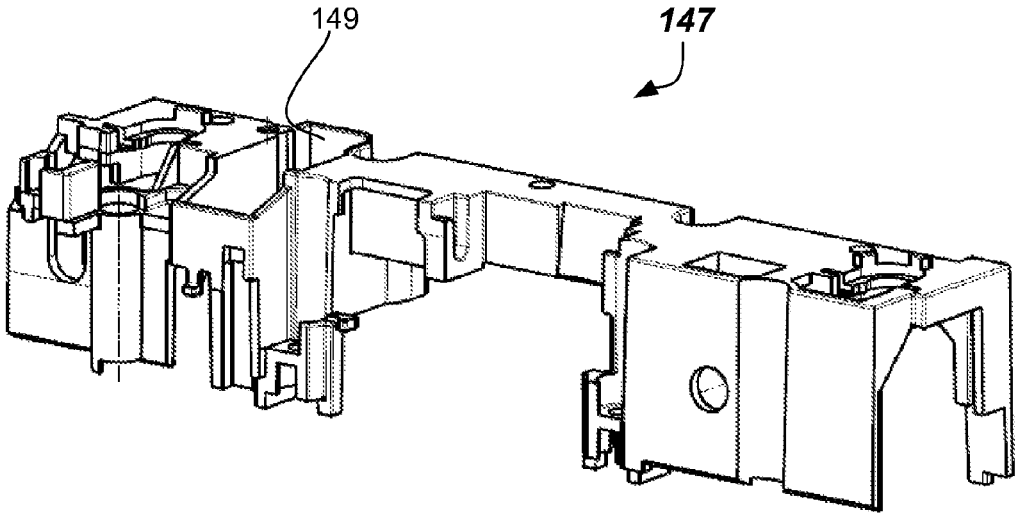
FIGS. 1E and 1F illustrate isometric views of an internal support of a base housing according to one or more embodiments.
Figure 1F:
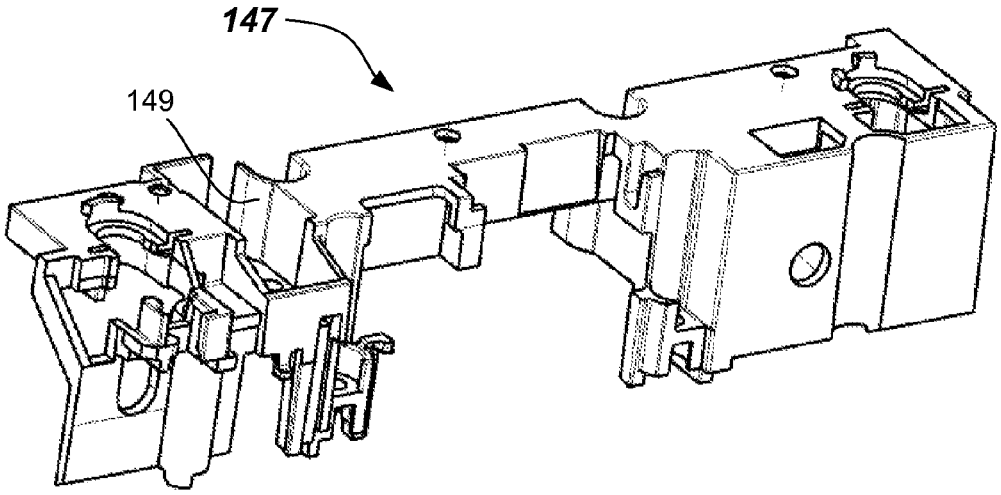
Figure 7A:
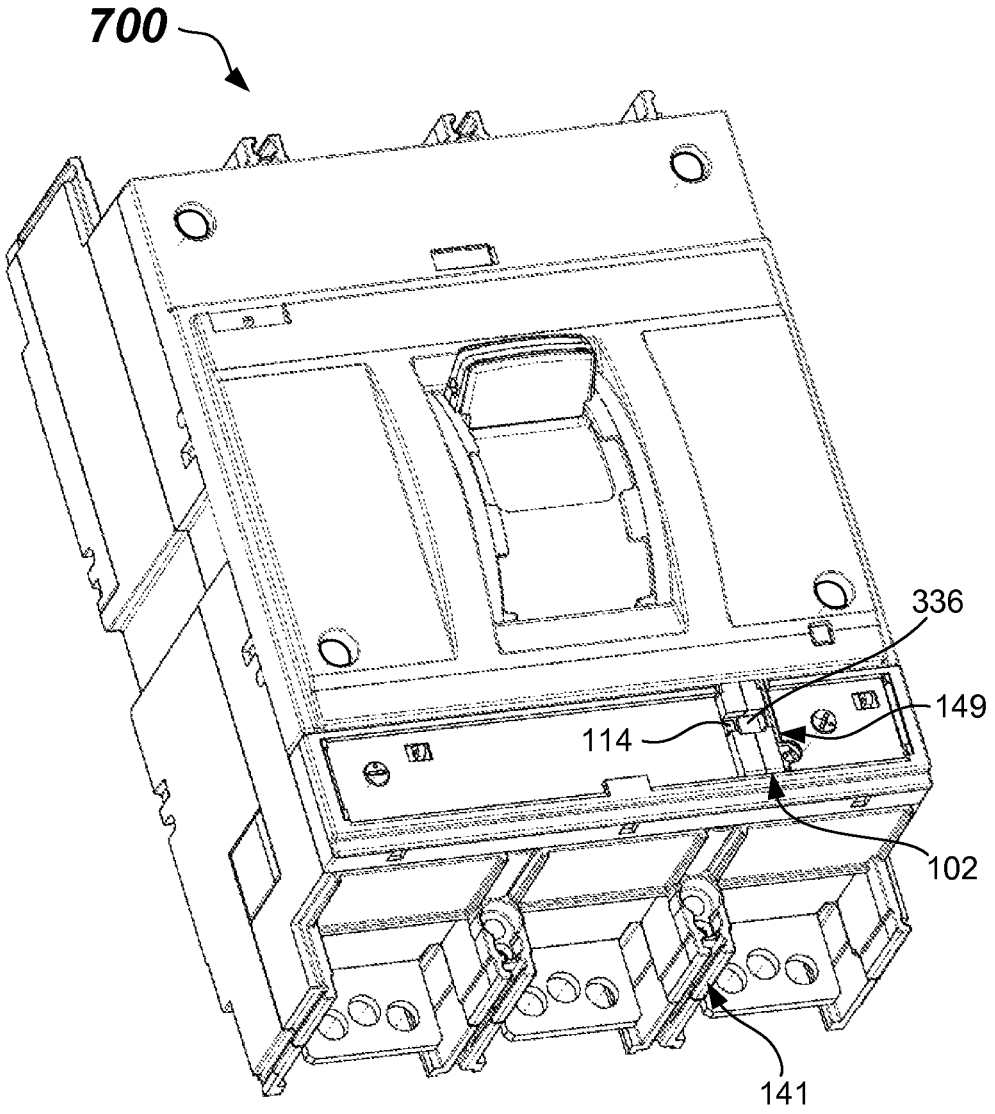
FIG. 7A illustrates a top isometric view of a thermal-magnetic circuit breaker including a short circuit indicating alarm module according to one or more embodiments.

FIGS. 1C and 1D illustrate isometric views of a modular assembly 141 adapted to couple to a circuit breaker (e.g., thermal-magnetic circuit breaker 700 shown in FIG. 7A). Modular assembly 141 includes the trip indicating assembly 100, which includes the short circuit indicating alarm module 102 and trip bar 104 housed within a base housing 143.

The base housing 143 includes a mounting base 145 and an internal support 147 (FIGS. 1E-1F) that may be configured to be coupled to the mounting base 145. Together, the mounting base 145 and the internal support 147 provide support and rotation surfaces for the trip bar 104 to rotate in, and an accessory pocket 149 configured to receive the short circuit indicating alarm module 102.

Also shown in FIGS. 1C and 1D, is a thermal trip bar 151, which may share a common axle with the trip bar 104. Trip bar 104 and thermal trip bar 151 are mounted in the mounting base 145 and are secured in place by the internal support 147.

Figure 2:
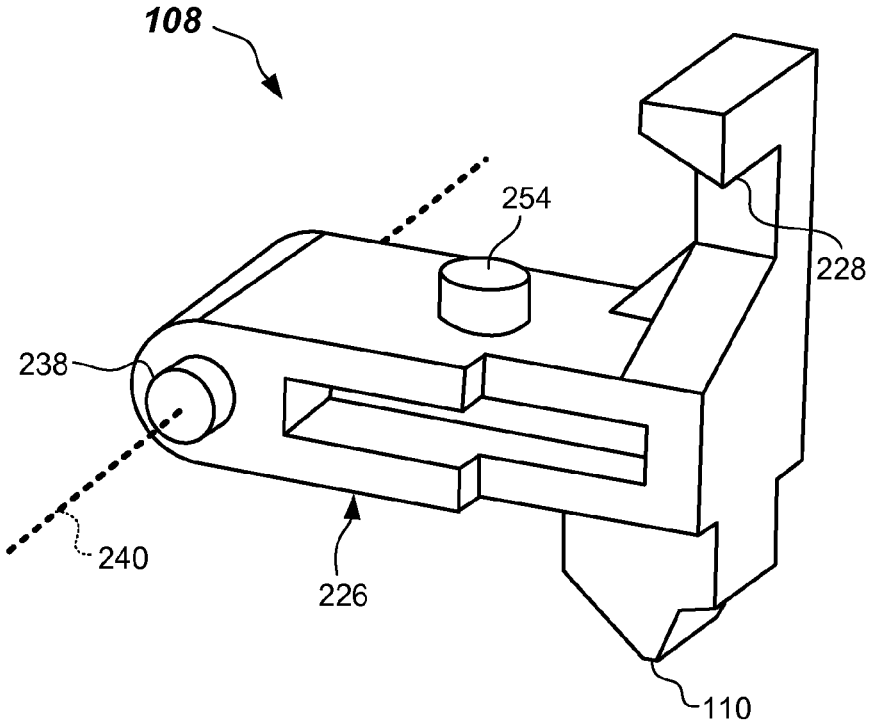
FIG. 2 illustrates an isometric view of a latch of the short circuit indicating alarm module according to one or more embodiments.

Referring now to FIG. 2, an isometric view of the latch 108 is shown. Latch 108 may include a latch body 226 and includes the latching member 110. The latching member 110 may extend in a first direction from the latch body 226. A trigger member 228 may extend in a second direction from the latch body 226 and may be moveable responsive to pivotal movement of the latch caused by contact between the latching member 110 and the catch 112. Trigger member 228 interacts with a release member 332 of a slider member 107 (see FIG. 3). Latch 108 may further include bearing pins 238 on a same relative location on either side of the latch 108 (only one shown) to provide a pivot axle 240 for the latch 108 to pivot around. Bearing pins 238 may be received in bores 553 formed in the first and second side cases 106A, 106B (see FIGS. 5A and 5B). Latch 108 may include a latch spring retainer 254 configured to interface with the latch spring 155 (FIGS. 1A and 1B). Latch 108 may be formed of a molded polymer material, such as Nylon, for example. Other suitably rigid materials may be used.

Figure 3:
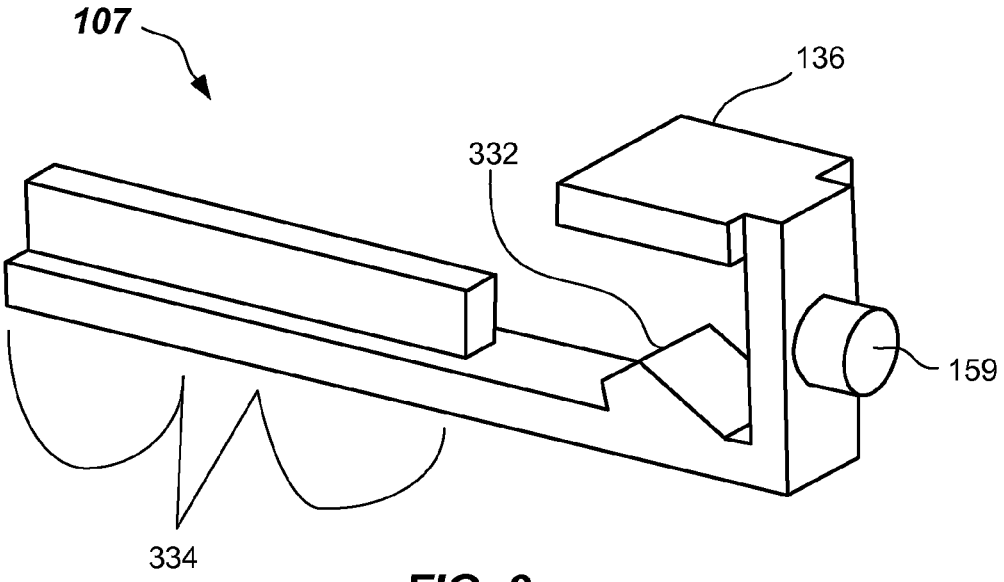
FIG. 3 illustrates an isometric view of a slider member of a short circuit indicating alarm module according to one or more embodiments.

Referring now to FIGS. 1A, 1B and 3, the slider member 107 is shown. Slider member 107 may include the release member 332, which is configured to engage with a trigger member 228 of the latch 108, a guide 334 configured to be received in a like-shaped feature formed from one or more cavities 537A, 537B formed in sidewalls in the first and second side cases 106A, 106B, and a trip indicating flag 136. Trip indicating flag 136 provides a visual indication that the circuit breaker (e.g., thermal-magnetic circuit breaker 700 shown in FIG. 7) has been tripped. Slider member 107 may be made from a rigid material, such as polycarbonate or nylon. Slider member 107 may be configured to translate upon tripping, wherein the trip indicating flag 136 is extended into a view window 158. View window 158 may be provided by a recess 539 (See FIGS. 5A-5B) of the housing 106. Slider member 107 may be spring biased to an extended condition when released from the latch 108 to move the trip indicating flag 136 into the view window 158. Spring bias may be provided by slider spring 150, which may register on slider spring retainer 159. Slider spring 150 may be a coil spring, for example. Other types of springs may be used.

Figure 4:
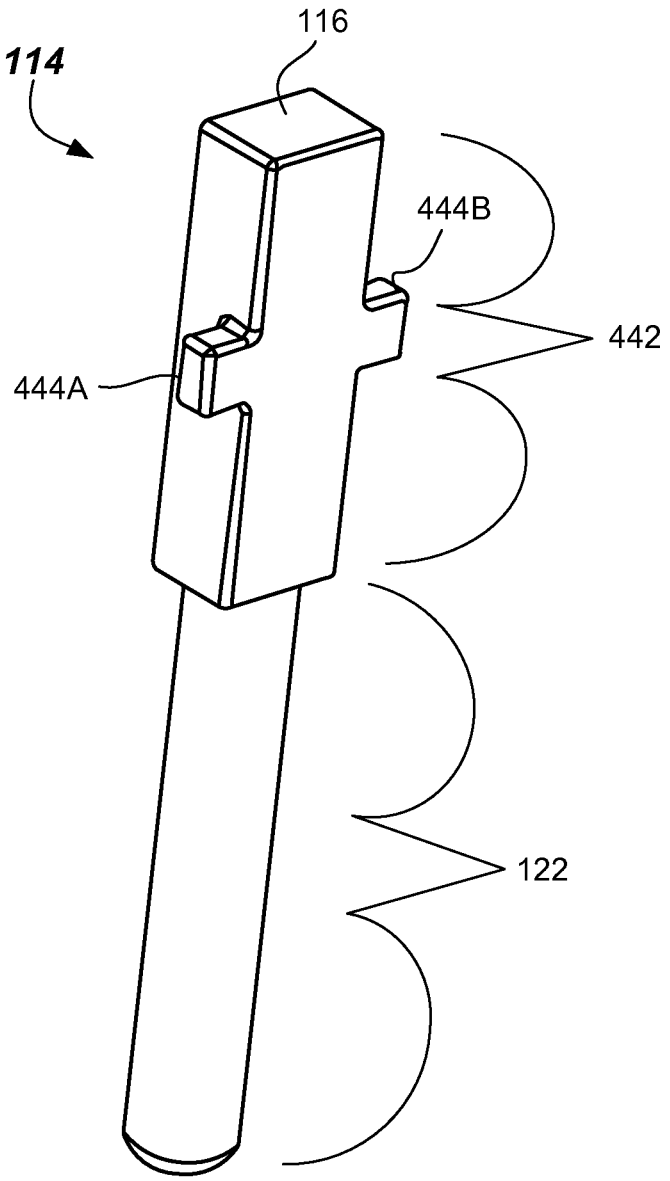
FIG. 4 illustrates an isometric view of a plunger of a short circuit indicating alarm module according to one or more embodiments.

Referring to FIG. 4, the plunger 114 may include a plunger body 442 and the shaft 122 extending from a bottom side of the plunger body 442, as shown. The plunger body 442 may include one or more stops 444A, 444B that may be received against a top surface (e.g., top inside surface 157) of the housing 106 to limit extension of the plunger 114. This limit of extension may position the upper end 116 of the plunger 114 at a position that is approximately even with an upper surface of the housing 106. The upper end 116 may be manually depressed by the operator to test the operability of the short circuit indicating alarm module 102 and any other accessory (e.g., a trip switch activated by the switch arm 123). As is shown in FIGS. 1A and 1B, a plunger spring 148 may be used to bias the plunger 114 to a top inside surface 157 of the housing 106. Furthermore, the shaft 122 of the plunger 114 may extend out of a bottom surface of the housing 106 to engage with the trip contact surface 124 of the trip bar 104.

Figure 5A:
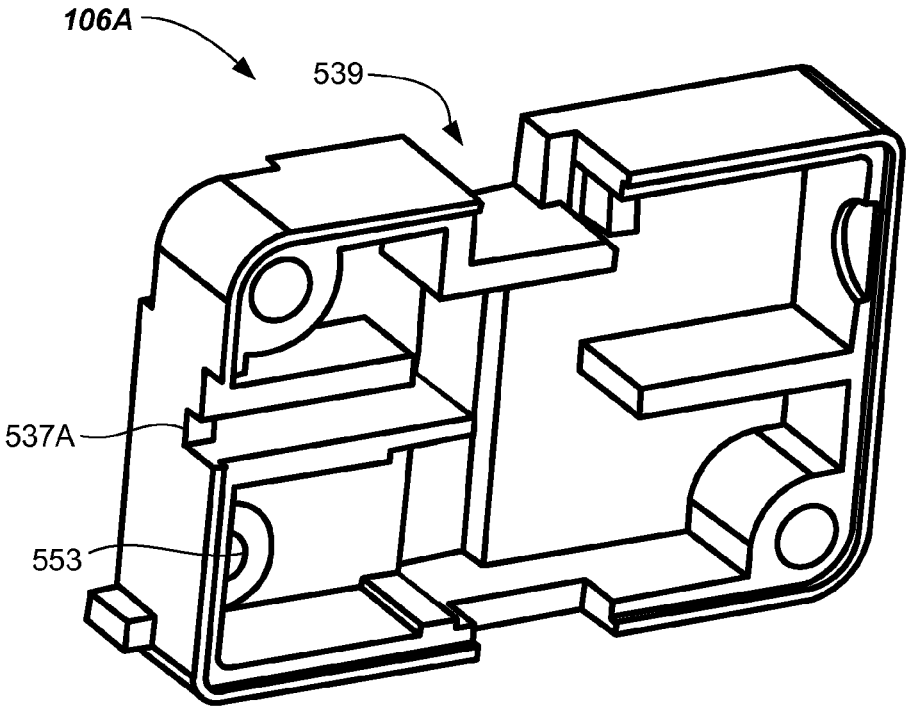
FIG. 5A illustrates an isometric view of a left side case of a housing of a short circuit indicating alarm module according to one or more embodiments.
Figure 5B:
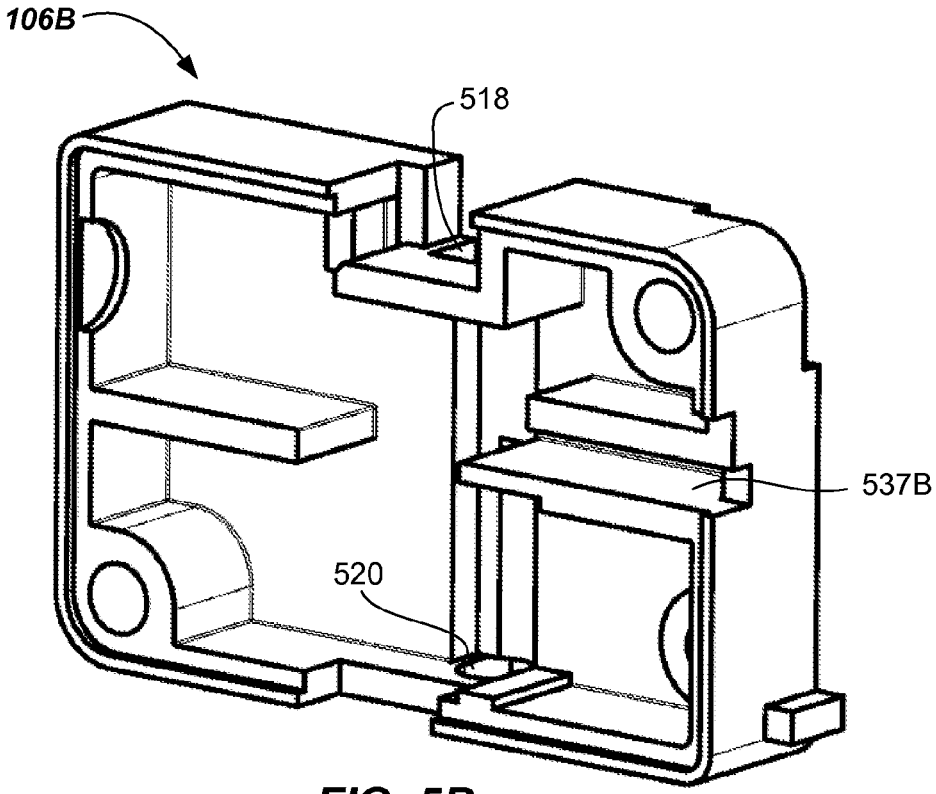
FIG. 5B illustrates an isometric view of a right side case of a housing of a short circuit indicating alarm module according to one or more embodiments.
Figure 6A:
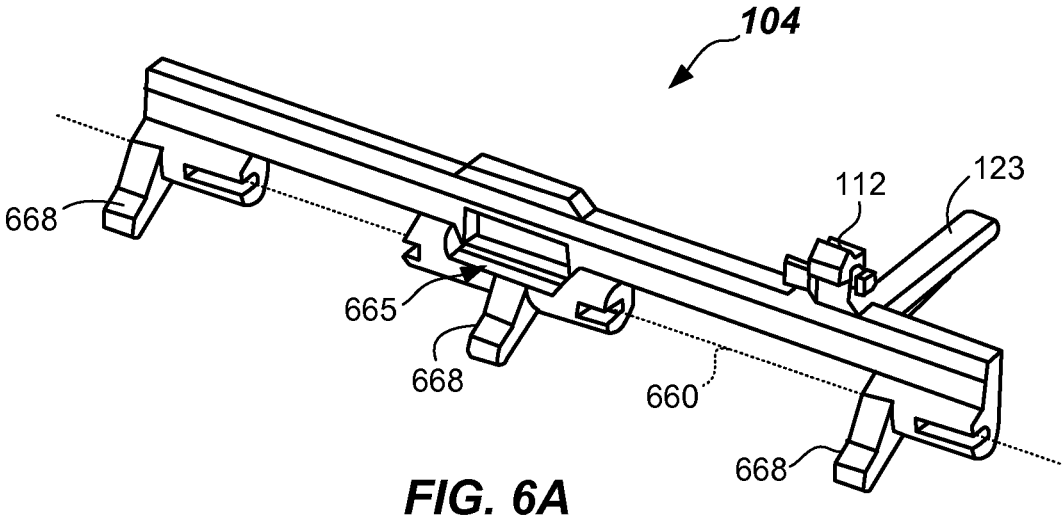
FIGS. 6A and 6B illustrate first and second side isometric views of a trip bar according to one or more embodiments.
Figure 6B:
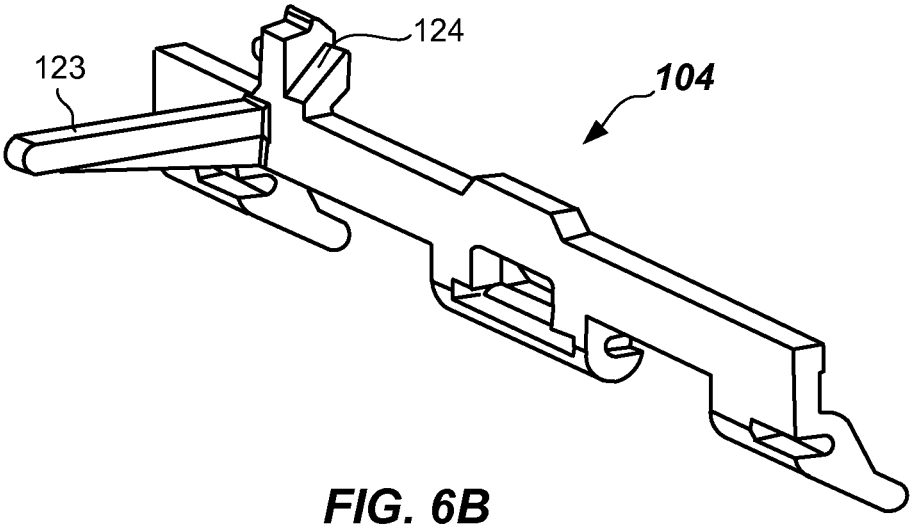

As shown in FIGS. 5A and 5B, the housing 106 may be made up of the first and second side cases 106A, 106B. First and second side cases 106A, 106B may be made from a suitable plastic material, for example. The material may be a thermoset material, such as a glass-filled polyester, or a thermoplastic material such as a Nylon material (e.g., Nylon 6), for example. Other suitable insulating materials may be used.

The first and second side cases 106A, 106B may be connected together to form the housing 106. Housing 106 may include an upper aperture 518 configured to receive the upper end 116 of the plunger 114. Housing 106 may include a lower aperture 520 configured to receive a shaft 122 of the plunger 114. Housing 106 may include a recess that comprises a view window 158 that receives the trip indicating flag 136 therein. Housing 106 may include the bores 553 in the first and second side cases 106A, 106B that may be configured to receive bearing pins 238 of the latch 108.

As shown in FIGS. 1A-1B and 6A-6B, the trip bar 104 includes a first end including the catch 112 and the trip contact surface 124, which are offset from the pivot axis 660. A magnetic interface portion 668 is operable with an armature and yoke assembly of the circuit breaker 700 to cause tripping of the trip bar 104 due to short circuits. Additional feature 665 may interface with the thermal trip bar 151.

Figure 7B:
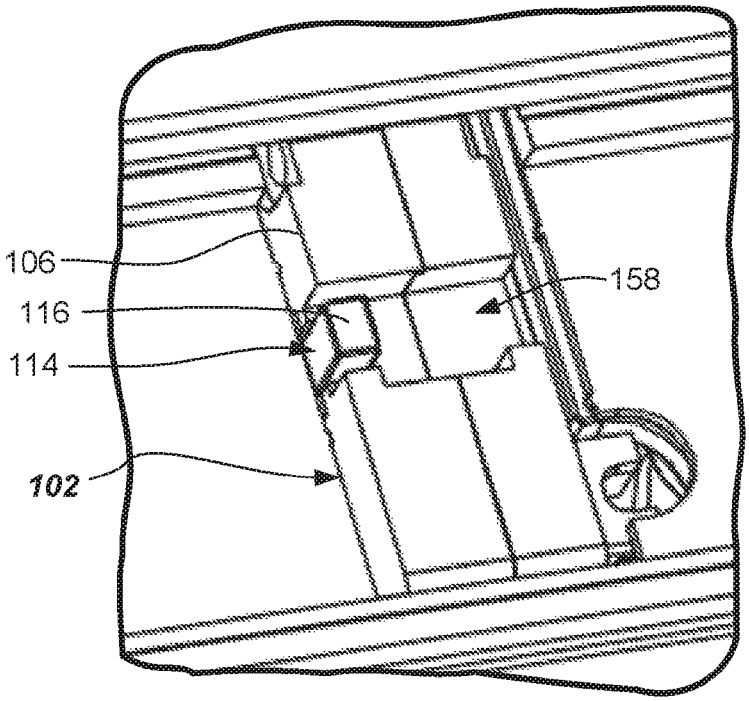
FIGS. 7B and 7C illustrate partial top isometric views of interactive components (e.g., plunger and trip indicator flag) of a short circuit indicating alarm module according to one or more embodiments.
Figure 7C:
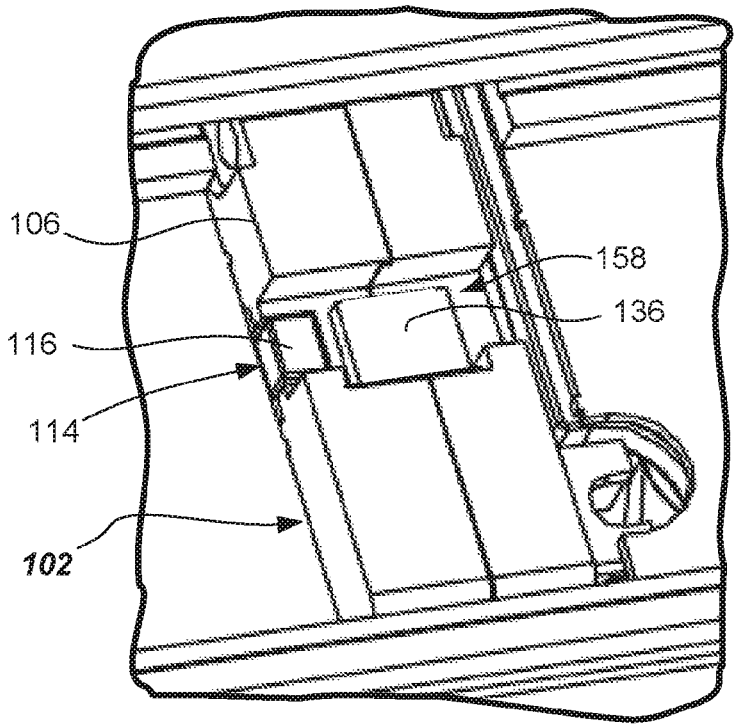

As shown in FIG. 7A, a thermo-magnetic, three-pole embodiment of a circuit breaker 700 is depicted including the short circuit indicating alarm module 102 in an accessory pocket 149 thereof. Circuit breaker 700 may be rated between 100 Amp and 2,000 Amp, for example. The accessory cover is shown removed, but would be re-installed with a window knocked out to allow physical access to the plunger 114 and visual access to the trip indicating flag 136. FIGS. 7B and 7C illustrate enlarged partial views of the view window 158 of the short circuit indicating alarm module 102 shown in an ON condition (FIG. 7B) and tripped condition (FIG. 7C).

Figure 8:
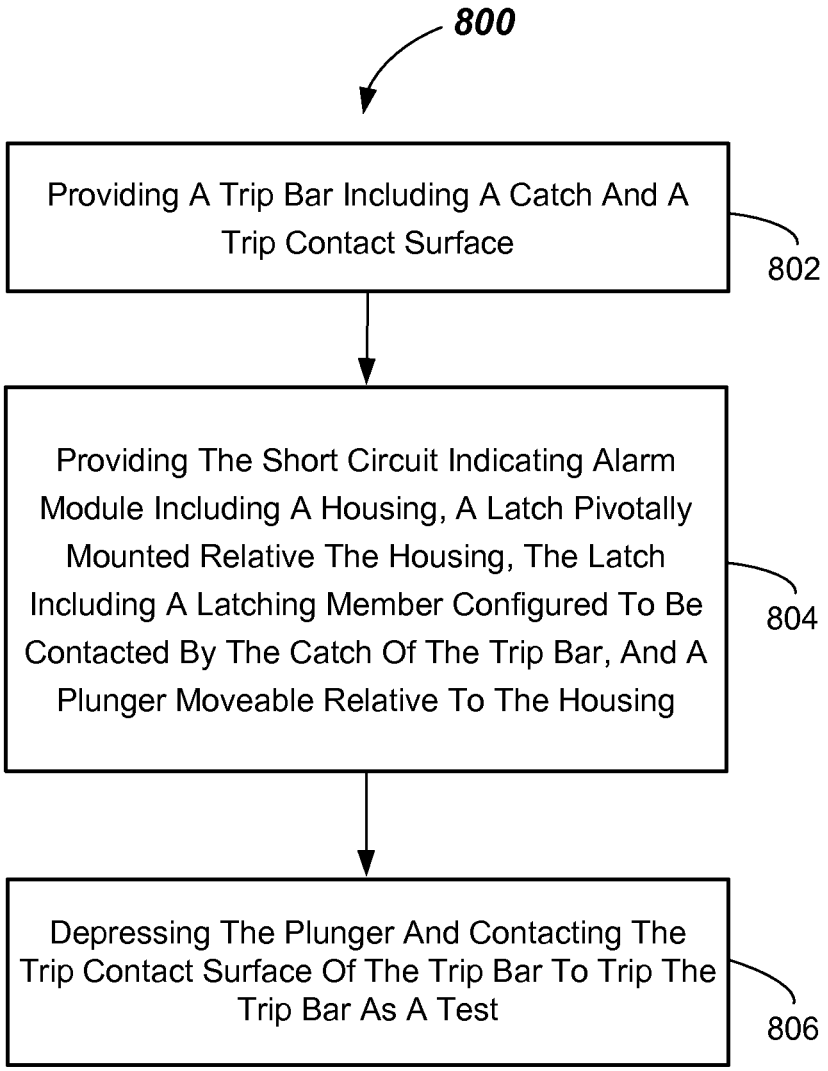
FIG. 8 illustrates a flowchart of a method of operating a short circuit indicating alarm module according to one or more embodiments.

According to another aspect, a method of testing a short circuit indicating alarm module is provided. As shown in FIG. 8, the method 800 includes, in 802, providing a trip bar (e.g., trip bar 104) including a catch (e.g., catch 112) and a trip contact surface (e.g., trip contact surface 124).

The method 800 includes, in 804, providing the short circuit indicating alarm module (e.g., short circuit indicating alarm module 102) including a housing (e.g., housing 106), a latch (e.g., latch 108) pivotally mounted relative the housing, the latch including a latching member (e.g., latching member 110) configured to be contacted by the catch (e.g., catch 112) of the trip bar (e.g., trip bar 104), and a plunger (e.g., plunger 114) moveable relative to the housing.

The method 800 includes, in 806, depressing the plunger (e.g., plunger 114) and contacting the trip contact surface (e.g., trip contact surface 124) of the trip bar (e.g., trip bar 104) to trip the trip bar as a test. Thus, the functionality of the short circuit indicating alarm module 102 may be tested without having to pass current through the circuit breaker (e.g., circuit breaker 600). Further, functionality of other accessories, such as a trip switch 129, may be tested. Thus, testing time and cost may be reduced, as well as wear on the electrical contacts of the circuit breaker 700.

While the invention is susceptible to various modifications and alternative forms, specific embodiments and methods thereof have been shown by way of example in the drawings and are described in detail herein. It should be understood, however, that it is not intended to limit the invention to the particular apparatus, assemblies, or methods disclosed herein, but to the contrary, the intention is to cover all modifications, equivalents and alternatives falling within the scope of the appended claims.

What is claimed is:

1. A short circuit indicating alarm module, comprising:
a housing;
a latch pivotally mounted relative the housing, the latch including a latching member configured to be contacted by a catch of a trip bar;
a plunger translatable relative to the housing and configured, upon depressing, to contact and trip the trip bar; and
a slider member configured to translate upon tripping, the slider member including a trip indicating flag.

2. The short circuit indicating alarm module of claim 1, wherein the housing includes a first part and a second part, and journals configured to receive bearing pins of the latch.

3. The short circuit indicating alarm module of claim 1, wherein the slider member is spring biased to an extended condition when released to move the trip indicating flag into a view window.

4. The short circuit indicating alarm module of claim 1, wherein the slider member includes a release member engageable with a trigger member of the latch.

5. The short circuit indicating alarm module of claim 1, wherein the latch includes a latch body, the latching member extending in a first direction from the latch body, and a trigger member moveable responsive to movement of the latching member.

6. The short circuit indicating alarm module of claim 1, wherein the plunger includes a plunger body including a shaft extending from the plunger body.

7. The short circuit indicating alarm module of claim 6, wherein the plunger body includes one or more stops that are received against a top surface of the housing to limit extension of the plunger.

8. The short circuit indicating alarm module of claim 6, comprising a plunger spring biasing the plunger to a top inside surface of the housing.

9. The short circuit indicating alarm module of claim 6, comprising a shaft of the plunger extending out of a bottom surface of the housing.

10. The short circuit indicating alarm module of claim 6, wherein the plunger comprises an upper end provided in a view window of the housing.

11. A trip indicator assembly, comprising:
a trip bar including a catch and a trip contact surface; and
a short circuit indicating alarm module, including:
a housing,
a latch pivotally mounted relative the housing, the latch including a latching member configured to be contacted by the catch of the trip bar,
a plunger translatable relative to the housing and configured, upon depressing, to contact the trip contact surface of the trip bar,
wherein a shaft of the plunger extending out of a bottom surface of the housing.

12. A trip indicator assembly, comprising:
a trip bar including a catch and a trip contact surface; and
a short circuit indicating alarm module, including:
a housing,
a latch pivotally mounted relative the housing, the latch including a latching member configured to be contacted by the catch of the trip bar,
a plunger translatable relative to the housing and configured, upon depressing, to contact the trip contact surface of the trip bar,
wherein the plunger comprises an upper end provided in a view window of the housing.

13. A trip indicator assembly, comprising:
a trip bar including a catch and a trip contact surface; and
a short circuit indicating alarm module, including:
a housing,
a latch pivotally mounted relative the housing, the latch including a latching member configured to be contacted by the catch of the trip bar,
a plunger translatable relative to the housing and configured, upon depressing, to contact the trip contact surface of the trip bar, and
a plunger spring biasing the plunger to a top inside surface of the housing.

14. The trip indicator assembly of claim 13, wherein the plunger includes a plunger body including a shaft extending from the plunger body.

15. The trip indicator assembly of claim 13, wherein the trip contact surface is inclined at an inclined angle of between about 25 degrees and about 50 degrees from an axial axis of the plunger.

16. The trip indicator assembly of claim 13, wherein the plunger includes a plunger body including one or more stops that are received against a top inside surface of the housing to limit extension of the plunger.

17. A modular assembly of a circuit breaker, comprising:
a base housing including an accessory pocket;
a trip bar mounted for rotation in the base housing about a pivot axis, the trip bar including a first contact area configured to be contacted by a mechanism of the circuit breaker, a catch offset from the pivot axis, and a trip contact surface; and
a short circuit indicating alarm module received in the accessory pocket, comprising:
a housing,
a latch pivotally mounted relative the housing, the latch including a latching member configured to be contacted by the catch of the trip bar,
a plunger moveable relative to the housing and configured, upon depressing, to contact the trip contact surface to trip the trip bar as a test, and
a plunger spring biasing the plunger to a top inside surface of the housing.

18. A method of testing a short circuit indicating alarm module of a circuit breaker, comprising:
providing a trip bar including a catch and a trip contact surface;
providing the short circuit indicating alarm module including:
a housing,
a latch pivotally mounted relative the housing, the latch including a latching member configured to be contacted by the catch of the trip bar,
a plunger moveable relative to the housing, and
a plunger spring biasing the plunger to a top inside surface of the housing; and
depressing the plunger and contacting the trip contact surface of the trip bar to trip the trip bar as a test.

* * * * *